United States Patent [19]

Harinishi

[11] Patent Number: 4,648,592

[45] Date of Patent: Mar. 10, 1987

[54] GYMNASTIC FLOOR STRUCTURE HAVING VERTICAL ELASTICITY

[76] Inventor: Atsushi Harinishi, 976 Uemachi, Izumisano-shi, Osaka, Japan

[21] Appl. No.: 748,688

[22] Filed: Jun. 25, 1985

[30] Foreign Application Priority Data

Jun. 28, 1984 [JP] Japan ..... 59-97884[U]
Jun. 30, 1984 [JP] Japan ..... 59-136345

[51] Int. Cl.[4] ..... A63J 3/00; E04B 5/43

[52] U.S. Cl. ..... 272/3; 52/228; 52/480; 52/582; 446/111; 428/17; 428/95

[58] Field of Search ..... 272/3, 4, 56.5 SS, 109; 52/227, 228, 480, 582, 384, 387, 470, 471, 564, 578, 579, 584, 285, 715; 404/34, 35, 36, 40, 41; 446/111, 112

[56] References Cited

U.S. PATENT DOCUMENTS

| | | | |
|---|---|---|---|
| 1,246,585 | 11/1917 | Geraerdts | 52/715 |
| 1,398,852 | 11/1921 | Gilbert | 446/112 |
| 2,025,794 | 12/1935 | Venzie | 52/715 X |
| 2,142,305 | 1/1939 | Davis | 52/582 X |
| 3,604,173 | 9/1971 | Dahlborg | 52/480 X |
| 3,771,891 | 11/1973 | Nirenski et al. | 272/3 X |
| 3,786,011 | 1/1974 | Price et al. | 428/17 X |
| 4,109,039 | 8/1978 | McCoy | 428/95 |
| 4,307,879 | 12/1981 | McMahon et al. | 272/3 |
| 4,373,033 | 2/1983 | Gupta | 428/95 X |
| 4,501,420 | 2/1985 | Dury | 272/3 |

FOREIGN PATENT DOCUMENTS

| | | | |
|---|---|---|---|
| 74725 | 7/1978 | Japan | 272/3 |
| 10525 | 1/1979 | Japan | 428/95 |
| 1478850 | 7/1977 | United Kingdom | 272/3 |
| 2067576 | 7/1981 | United Kingdom | 428/95 |

*Primary Examiner*—Robert A. Hafer
*Assistant Examiner*—Arnold W. Kramer
*Attorney, Agent, or Firm*—Koda and Androlia

[57] ABSTRACT

A gymnastic floor structure comprising a panel board assembly, lower floor members spacedly secured to the bottom of the panel board assembly and placed on the gymnasium base floor, an upper floor member, and tighteners which prevent panels of the board assembly from loosening in the connecting directions, wherein the lower floor members are made of synthetic resin foam, the connectors have an almost I-shaped cross section composed of two U-shaped channels integrated back to back, one channel of the connectors is used as a fitting part between two adjacent panels, the fixing part of the connectors is fitted to the side edge portion of one unit panel board and secured with fasteners, and the fitting part is fitted to the side edge portion of the other unit panel board. The upper floor member is an elastic mat and carpet which covers the panels. The lower floor members and elastic mat are made of ethylene vinyl acetate resin foam modified by ethylene propylene rubber and butadiene rubber having an impact resilience of 50 to 60%.

3 Claims, 9 Drawing Figures

FIG. 4

FIG. 8 (a) (Prior Art)
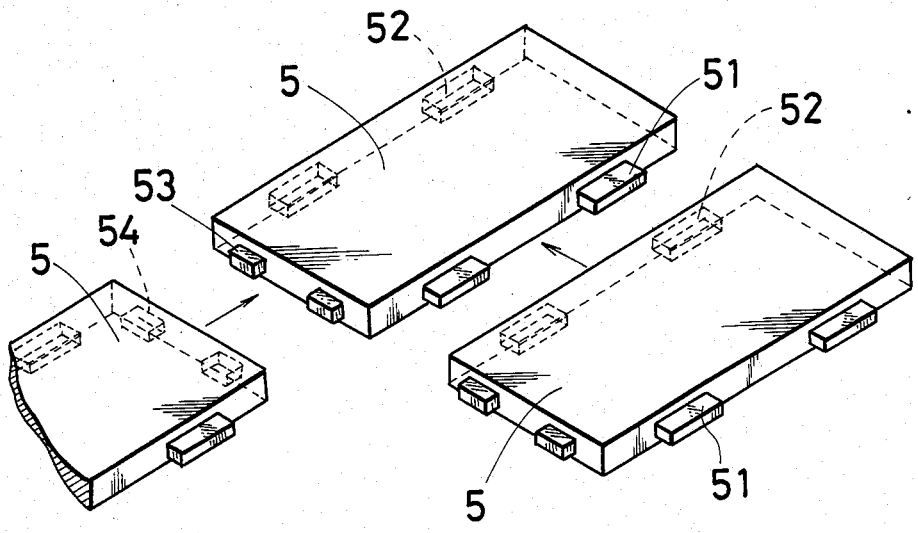
FIG. 8 (b) (Prior Art)
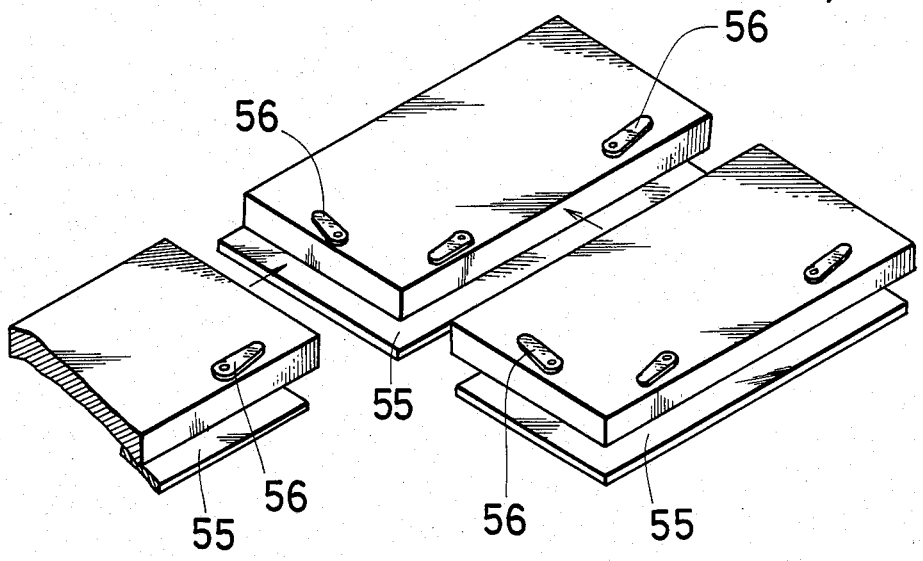

GYMNASTIC FLOOR STRUCTURE HAVING VERTICAL ELASTICITY

BACKGROUND OF THE INVENTION

1. Field of the Invention

The present invention relates to a gymnastic floor structure used for floor exercises, and more particularly relates to a gymnastic floor structure which is composed of a plurality of unit panel boards combined together using connecting and tightening means.

2. Prior Art

There have been mainly two types of gymnastic floor structures used as a 12×12 meter gymnastic floor for gymnastic competitions held under the auspices of the F.I.G. (Federation of International Gymnastics) and other similar gymnastic bodies. As shown in FIGS. 8(*a*) and 8(*b*), sixty unit panel boards 5 each measuring 2,000 mm×1,200 mm or 48 unit panel boards 5 each measuring 2,000 mm×1,500 mm are combined by fitting projections 51 and 53 into recesses 52 and 54 provided on the side edges of the boards 5 or by using base plates 55 and latch members 56. Then the circumference of the combined boards is surrounded with ropes (not shown).

A structure very similar to the structures shown in FIG. 8(*a*) or 8(*b*) has also been used for a tumbling floor, a kind of gymnastic floor used for gymnastic exercises.

Recently, extremely difficult gymnastic performances have been frequently attempted so that the requirements for gymnastic floors have become exacting. In the floor structures of the prior art described above, the unit panel boards are loosely connected and thus low in safety. Furthermore, the floor elasticity is not enough to meet the requirements for the development of new performances based on harsh jumps and landings. The above disadvantages of the gymnastic structures of the prior art indicate an obvious need for an innovative gymnastic floor structure.

SUMMARY OF THE INVENTION

It is therefore an object of the present invention to provide a gymnastic floor structure which can meet the above needs, i.e., secure connection of unit panel boards and high impact resilience against external forces such as jumping forces.

It is also an object of the present invention to provide unit panel boards which can be assembled easier than conventional unit panel boards.

The gymnastic floor structure of the present invention includes a panel board assembly composed of a plurality of rectangular unit panel boards closely connected with one another on a flat plane and tightly connected together using connecting means, lower floor members composed of a plurality of elastic support members which are spacedly secured to the bottom of the panel board assembly and placed on a gymnasium base floor to elastically repulse external forces such as jump forces applied onto the panel board assembly, upper floor members which are placed on the panel board assembly to elastically support the external forces, and tightening means which prevent the panel board from loosening in the connecting directions. The elastic support member is made of synthetic resin foam. The connecting means has an almost I-shaped cross section composed of two U-shaped channels integrated back to back. One channel of the connecting means is used as a fixing part and the other channel is used as a fitting part. Between two adjacent unit panel boards, the fixing part of the connecting means is fitted to the side edge portion of one unit panel board and secured with fastening means, and the fitting part is fitted to the side edge portion to the other unit panel board.

BRIEF DESCRIPTION OF THE DRAWINGS

The above mentioned features and objects of the present invention will become apparent from the following description taken in conjunction with the accompanying drawings, wherein like reference numerals denote like elements and in which:

FIGS. 8(*a*) and 8(*b*) are explanatory drawings illustrating the conventional panel board connection structures.

DETAILED DESCRIPTION OF THE INVENTION

Figure 1:
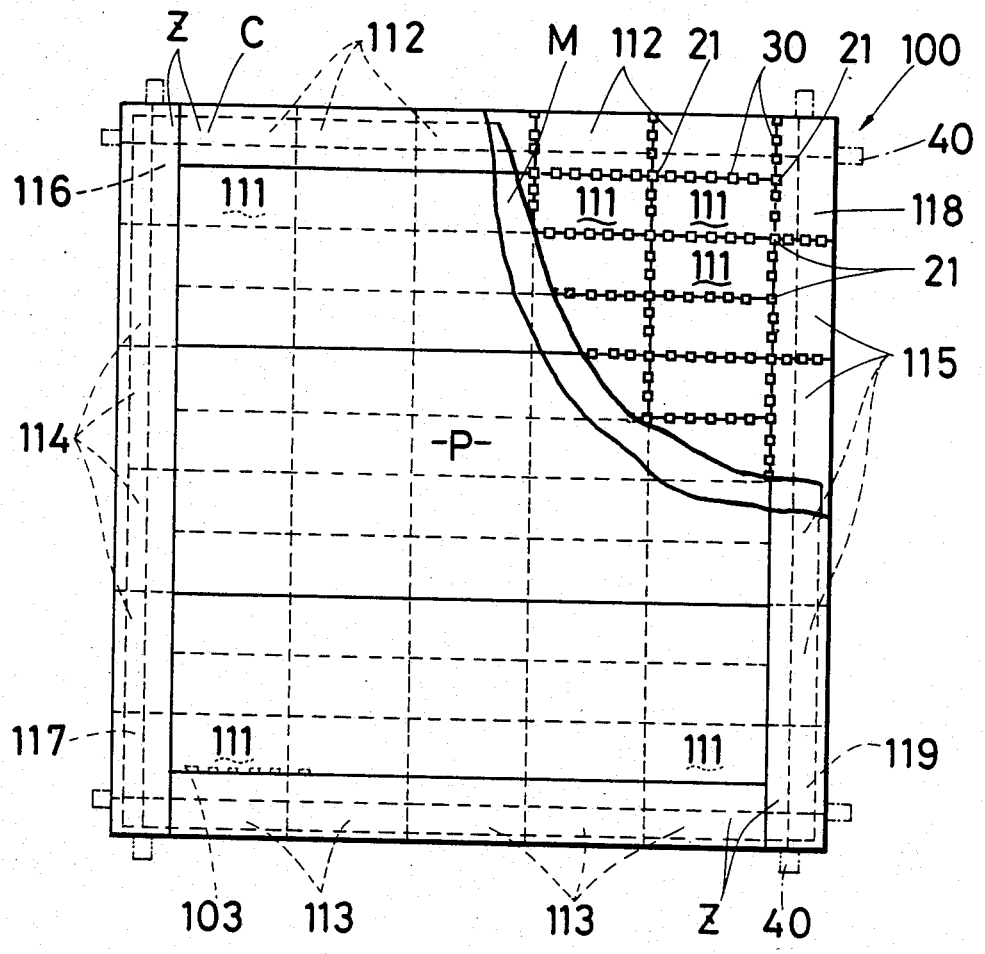
FIG. 1 is a partially cutaway plan view illustrating an embodiment of the gymnastic floor structure of the present invention.
Figure 2:
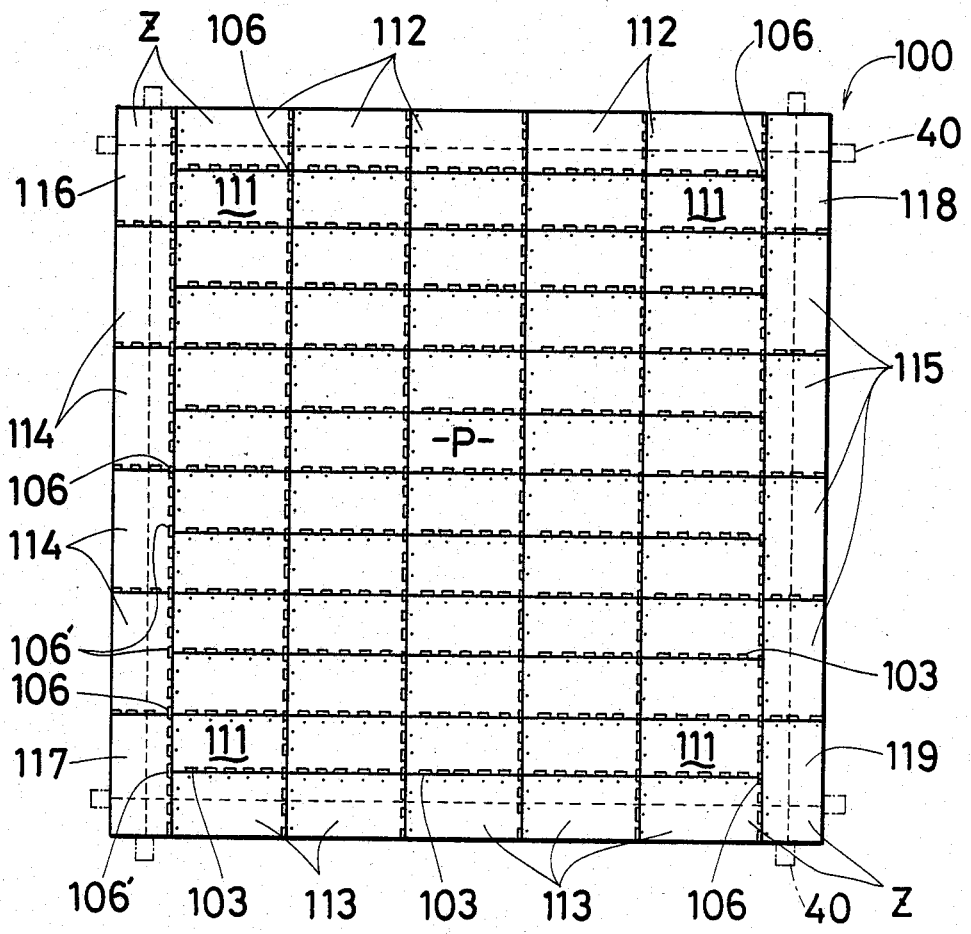
FIG. 2 is a plan view illustrating the unit panel board assembly forming the gymnastic floor structure with connecting means not shown.
Figure 3:
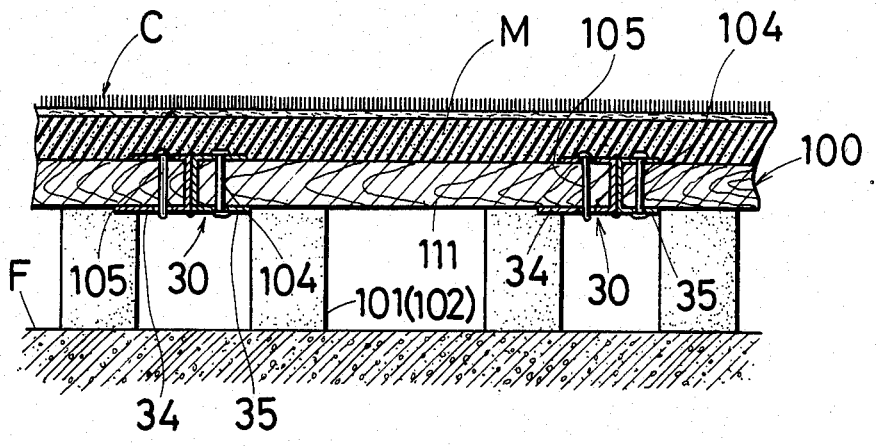
FIG. 3 is a partial cross-sectional view illustrating the gymnastic floor structure.

Referring to FIGS. 1 and 2, numeral 100 is a panel board assembly which is the basic structure of the gymnastic floor structure of the present invention. As shown in FIG. 3, elastic support members 101 and 102 made of rubber-modified polyolefin-based resin foam, preferably ethylene vinyl acetate resin (EVA) foam (impact resiliences: 50 to 60%, multiplying factor: 5 to 6) modified by ethylene propylene rubber and butadiene rubbers (all of which are well known in the chemical arts) are secured (e.g. adhered) to the bottom of the panel board assembly 100 as the lower floor members. As the upper floor members, a mat M made of EVA foam is placed on the top of the panel board assembly 100 and a cut pile carpet C is placed on the mat M. A plurality of rectangular unit boards 111 and 119 made of plywood veneer measuring approximately 15 mm in thickness are connected to one another to form a 12×12 meter square floor for the gymnastic performance. This floor is surrounded by one-meter wide safety zones. These unit panel boards are assembled on the gymnasium base floor F.

Figure 4:
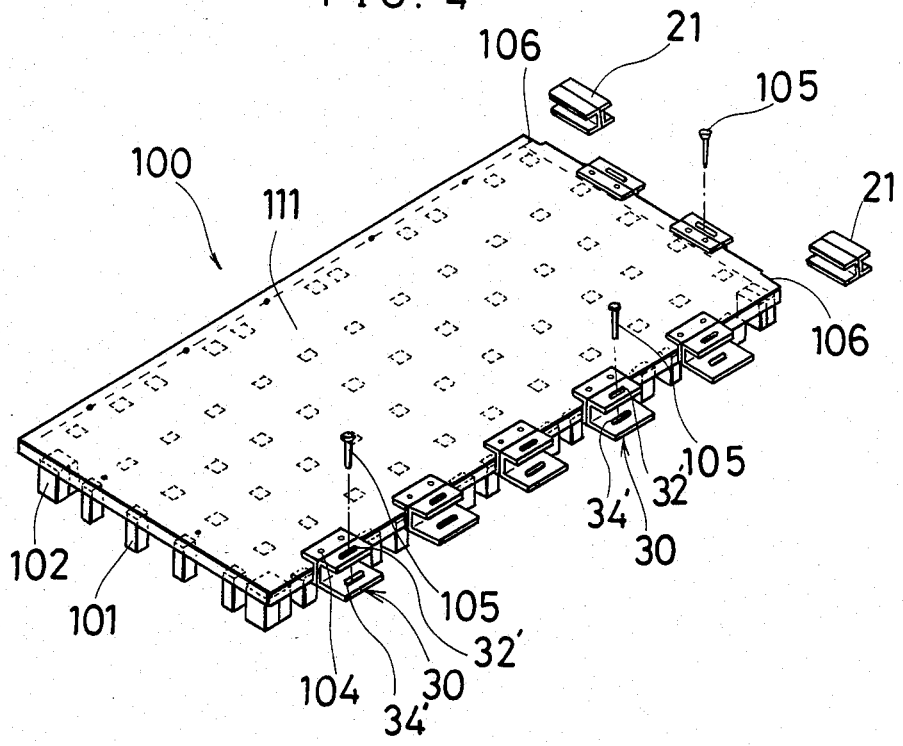
FIG. 4 is a perspective view illustrating the panel board assembly structure for gymnastic performances.
Figure 5:
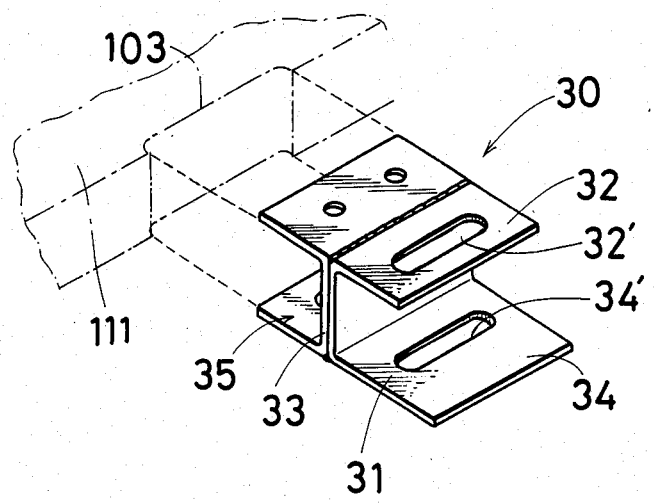
FIG. 5 is a perspective view of the connecting means.

The unit panel boards 111 to 118 (except 119) are connected using connecting means 30 as shown in FIG. 5. The connecting means has an almost I-shaped cross section composed of two U-shaped channels integrated back to back. The one channel of the connecting means (left channel shown in FIG. 5) is used as a fixing part 35 and the other channel (right channel shown in FIG. 5) is used as a fitting part 31. The lower flat portion of the fitting part 31 is slightly longer than the upper flat portion. These connecting means 30 are placed at the side edge portions of the unit panel boards 111 to 119. In the preferred embodiment, the web 33 of the connecting means 30 is fitted to the U-shaped recess 103, which is disposed on the panel board edges and has a depth slightly greater than the thickness of the web 33, so that the unit panel boards can be connected without clearances at the connection sections. A slot 32' is disposed in the upper flat portion 32 of the connecting means 30 and a slot 34' is disposed in the lower flat portion 34. The fixing part 35 of the connecting means 30 is fitted to the recess 103 of the panel board 111 and is fixed using rivets 104 (FIG. 4) and the fitting part 31 is fit to the adjacent unit panel board 111 and is fixed using pins 105. In this way, the unit panel boards 111 are connected in both the lengthwise and the widthwise directions.

It is evident that a plurality of connecting means 30 placed at the lengthwise and widthwise adjacent boundaries of the unit panel boards function to join the unit panel boards. A corner connecting means 21 (FIG. 4), which is almost the same as the connecting means 30 in shape and is slightly smaller in size, is fitted to the corner recess 106 to connect the unit panel boards at the corners. Unlike the connecting means 30, the upper and lower flat portions of the corner connecting means 21 are the same in length. Thus the corner connecting means 21 has a regular I-shaped cross section. The means 21 simply fit together rather than being fixed together as are the connecting means 30.

Each unit panel board 111 is a rectangle measuring 1,200×2,400 mm. Totally 50 unit panel boards 111 are used to form the floor for gymnastic performance P. One of the long-side edges of the unit panel board 111 has five recesses 103 and one of the short-side edges of the board has two recesses 103 to fix the connecting means 30 (FIG. 2). Furthermore, the short-side edge has a recess 106 at each corner to accomodate the corner connecting means 21. At the upper (rear) side of the connected unit panel boards 111 forming the floor structure for gymnastic performance P shown in FIG. 5, five rectangular unit panel boards 112 measuring 1,000×2,400 mm each are provided to form a safety zone Z. Each unit panel board 112 is fixed using five connecting means 30 at its long-side edge and three connecting means 30 at its short-side edge. The unit panel board 112 has a recess 106 at the inner corner of the short-side edge to accomodate the corner connecting means 21.

Furthermore, at the lower (front) side of the connected unit panel boards 111 forming the floor for gymnastic performance P, five rectangular panel boards 113 measuring 1,000×2,400 mm each are provided to form a safety zone Z. Each unit panel board 113 is fixed using three connecting means 30 at its short-side edge and has a recess 106 at its inner corner of the short-side edge to accomodate the corner connecting means 21. At the left side of the connected unit panel boards 111 forming the floor for gymnastic performance P, one rectangular unit panel board 116 measuring 1,000×2,200 mm, four rectangular unit panel boards 114 meassuring 1,000×2,400 mm each and one rectangular unit panel boards 117 measuring 1,000×2,200 mm are provided to form a safety zone Z. The unit panel board 116 is fixed using five connecting means 30 at its right-hand long-side edge and three connecting means 30 at its lower short-side edge. The unit panel board 116 has a recess 106' at the center of its right-hand long-side edge and a recess 106 at the lower corner of its lower short-side edge to accommodate the corner connecting means 21. Likewise, the panel board 114 is fixed using four connecting means 30 at its right-hand long-side edge, and using three connecting means 30 at its lower short-side edge and has a recess 106' at the center of its right-side long-side edge and a recess 106 at the upper and lower corners of its right-hand long-side edge to accommodate the corner connecting means 21. Also, the unit panel board 117 is fixed using five connecting means 30 at its right-hand long-side edge and has a recess 106' at the center of its right-hand long-side edge and a recess 106 at the upper corner of its right-hand long-side edge.

At the right side of the connected panel boards 111 forming the floor for gymnastic performance P, one panel board 118 measuring 1,000×2,200 mm, four panel boards 115 measuring 1,000×2,400 mm each and one panel board 119 measuring 1,000×2,200 mm are provided to form a safety zone Z. The unit panel board 118 is fixed using three connecting means 30 at its lower short-side edge. The unit panel board 115 is fixed using three connecting means 30 at its lower short-side edge. The unit panel board 119 has neither connecting means nor recess. These unit panel boards 111 to 119 are connected using connecting means 30, pins 105 and corner connecting means 21 to form the panel board assembly 100.

Figure 6:
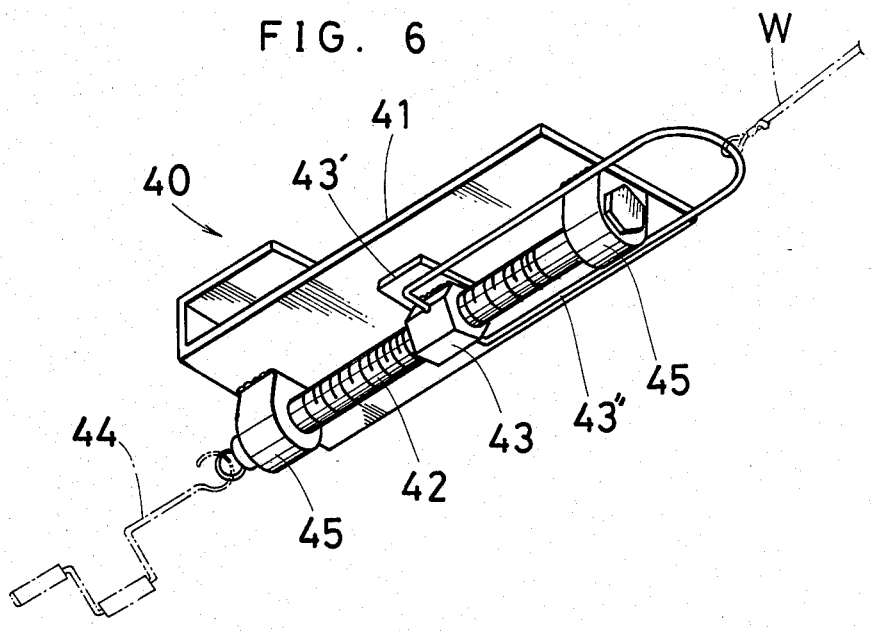
FIG. 6 is a perspective view of the panel board assembly tightening means.

As shown in FIG. 6 this panel board assembly 100 is tightened using tightening tools 40 in which a moving piece 43 is moved by the rotation of a screw rod 42 rotatably supported by bearings 45 under a hook plate 41 and a wire W is connected to the moving piece 43. These tools are hooked to the unit panel boards 116, 117, 118 and 119 located at the four safety zone corners in the lengthwise and widthwise directions, as shown in FIG. 2. By turning a handle 44 and thusly pulling the wire W, the panel board assembly 100 forming the floor for gymnastic performance P is tightened to complete the basic structure of the gymnastic floor structure of the embodiment. The moving piece 43 is welded to a flange plate 43' which prevents the moving piece 43 from rotating together with the screw rod 42, and a connection loop 43" which is connected to the wire W. By use of these tightening tools 40, the panel board assembly 100 has much more uniform elasticity and higher safety value.

Pole-shaped synthetic resin foam members as lower floor members (not shown) are further secured to the bottom of the circumference of the unit panel boards 112, 113, 114, 115, 116, 117, 118 and 119 forming the one-meter wide safety zones Z to prevent excessive softness at the circumference portions so as to provide uniform elasticity over the entire floor surface. Therefore, the safety zones Z have higher safety and are useful in daily exercise.

Preferably, ethylene vinyl acetate resin foam modified by butadiene rubber and ethylene propylene rubber is the most appropriate material for the elastic support members 101 and 102 which are secured to the bottom of the unit panel board assembly 100 as the lower floor members. The above resin foam has the characteristics listed below.

| TEST ITEM | RESULT | REMARKS |
|---|---|---|
| Multiplying Factor | 5–6 | |
| Impact Resilience Rate | 50–60% | JIS K6301 |
| Tensile Strength | 13–15 kg/cm$^2$ | " |
| Tearing Strength | 4–6 kg/cm$^2$ | " |
| Elongation | 250–270% | " |
| Friction Coefficient | 1.30 × 1.40 | * |
| Restoration Rate | 99.4–99.7% | KDK S0607 |
| Permanent Compressive Strain After Repeated Compression | 3.5–3.8% | JIS K6767 |

-continued

| TEST ITEM | RESULT | REMARKS |
|---|---|---|
| (Repeated Compression Test) | | |

*For decoration plywood conforming to ASTM.

Judging from the characteristics listed above, the elastic support members 101 and 102 made of the rubber-modified polyolefin-based resin foam have superior impact resilience, sufficiently withstand repetitive impacts applied by hard exercises, do not cause slippage and provide greater resilience. Thus the gymnasium base floor is not impaired. Furthermore, the elastic support members are superior in durability and form restoration even when external forces are repeatedly applied. They also have a high friction coefficient to prevent the panel board assembly from moving even after being used for an extended period. Moreover, the elastic support members provide less vibration (since they have lower characteristic frequency) when a performer lands on the gymnastic floor, and sound generated by a performer is minimal. Therefore, the elastic support members are the most suitable for gymnastic floors. These elastic support members 101 and 102 are preferably rectangular posts measuring 50×40×50 mm and 80×80×50 mm respectively, and are for instance adhered using a synthetic rubber-based adhesive to the bottom of the 15 mm thick unit panel boards 111 to 119 made of plywood veneer (first class veneer conforming to JIS) at proper intervals so that uniform impact resilience is delivered.

The mat M placed on the panel board assembly 100 is wider than the area for gymnastic performance and is composed of dovetail-groove-connected 144 sheets of 165×165 mm square unit mats which are made of 20 mm thick ethylene vinyl acetate resin foam modified by butadiene rubber and ethylene propylene rubber, and a three-division nylon cut pile carpet C connected using Velcro (magic) tape is placed on the top of the mat M (not shown). The area for gymnastic performance P and the safety zones on the carpet C are distinguished from each other by color. Both the elastic mat M and the carpet C placed on the mat M elastically absorb the external forces applied by the entire sole surface of a performer when he lands on the mat and also absorbs impacts applied when a performer falls. This ensures higher safety. This mat M is the most suitable for gymnastics since it has superior durability, high impact resilience and superior impact absorbing ability and does not cause slippage due to high friction coefficient. The carpet C is preferably made of heat-set 66 nylon (commercially obtain-able under the trade name Leona 66 (R) sold by Asahi Chemical Industry Co., Ltd.) three-strand threads having long-cut pile. In the carpet C, the weaving density in the lengthwise direction differs from that in the widthwise direction to reduce slippage when a performer jumps and yet to allow slippage when a performer spins on his or her toes. The carpet C is supple and superior in durability and safety, and has features suited for gymnastic exercises.

Figure 7:
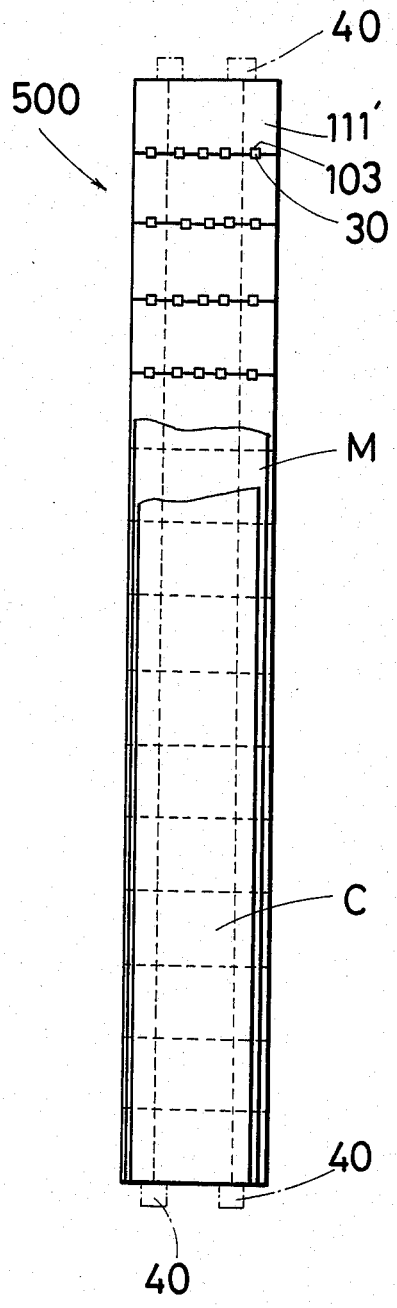
FIG. 7 is a plan view of a tumbling floor structure, an application of the present invention.

The panel board assembly used for the tumbling floor 500 show in FIG. 7 is composed of a plurality of unit panel boards 111' connected to one another by fitting the connecting means 30 to the five recesses 103 provided along a long-side edge of each unit panel board 111' to form an 18 meter long tumbling floor and by tightening the connected boards using wo pairs of the tightening means 40. The upper and lower members of the panel board assembly for this tumbling floor are similar to those for the above-mentioned gymnastic floor 100.

With the gymnastic floor structure of the present invention, the elastic support members spacedly disposed on the gymnasium base floor and secured to the bottom of the panel board assembly function in cooperation with the panel board assembly to elastically deform over a wide range when an external force is partially applied by a toe of a performer and to deliver highly uniform impact resilience. Furthermore, the pole-shaped elastic support members are spacedly disposed to deliver uniform impact resilience over the entire floor area. This helps a performer improve his performance skills. The elastic support members have lower characteristic frequency so that a performer can land stably. In addition, sound generated when a performer jumps from and lands on the floor is minimal over the entire floor not to disturb his action.

The upper floor members composed of the elastic mat made of resin foam for example and placed on the panel board assembly together with the carpet placed on the mat elastically support external forces applied by a performer when he lands with his entire sole surface. This ensures stability of performance. The upper floor members also absorb impacts applied to a performer when he falls, to ensure safety. Moreover, unlike the conventional double-layer floor, the production cost of the gymnastic floor of the present invention can be drastically reduced, since the panel board assembly is one layer of connected and tightened unit panel boards, and the elastic support members are secured only to the bottom of the panel board assembly.

It should be apparent to those skilled in the art that the above described embodiment is merely illustrative of one embodiment of the present invention. Numerous and varied other embodiments can readily be devised by those skilled in the art without departing from the spirit and scope of the present invention.

I claim:

1. A gymnastic floor structure comprising a panel board assembly composed of a plurality of rectangular unit panel boards closely connected with one another on a flat plane and connected by connecting means, lower floor members composed of a plurality of elastic support members which are spacedly secured to the bottom of said panel board assembly and placed on a gymnasium base floor to elastically repulse external forces such as jump forces applied onto said panel board assembly, an upper floor member placed directly on and in contact with substantially all of an upper surface of said panel board assembly to elastically support the external forces, said upper floor member comprising an elastic mat and a carpet placed on said mat, and said elastic mat is made of ethylene vinyl acetate resin foam modified by ethylene propylene rubber and butadiene rubber and functioning in cooperation with said carpet to elastically support external forces applied onto said carpet, and tightening means which prevent said unit panel board assembly from loosening in the connecting directions, wherein said elastic support members are made of ethylene vinyl acetate resin foam modified by ethylene propylene rubber and butadiene rubber having a multiplying factor of 5 to 6, said connecting means have an almost l-shaped cross section composed of two U-shaped channels integrated back to back, one channel of said connecting means is used as a fixing part and the other channel is used as a fitting part, between two adjacent unit panels, said fixing part of said connecting means is to fit to the side edge portion of one unit panel board and secured with fastening means, and said fitting part is fitted to the side edge portion of the other unit panel board.

2. A gynmastic floor structure according to claim 1, wherein the web of said connecting means is fit to recesses on side edge portions of said unit panel board, the depth of said recess is greater than the thickness of said web, and the lower flat plate portion of said connecting means is slightly longer than the upper flat plate portion.

3. A gymnastic floor structure according to claim 1, wherein said ethylene vinyl acetate resin foam modified by ethylene propylene rubber and butadiene rubber has an impact resilience of 50 to 60%.

* * * * *